US011540612B1

(12) United States Patent
Zheng et al.

(10) Patent No.: US 11,540,612 B1
(45) Date of Patent: Jan. 3, 2023

(54) COSMETIC PACKAGE FOR DISPENSING AND APPLYING A FLUID PRODUCT

(71) Applicant: APR Beauty Group Inc, Toronto (CA)

(72) Inventors: Min-Yan Zheng, Toronto (CA); Feng-Ying Fu, Markham (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 46 days.

(21) Appl. No.: 17/412,118

(22) Filed: Aug. 25, 2021

(51) Int. Cl.

| | |
|---|---|
| ***A45D 40/26*** | (2006.01) |
| ***A45D 34/04*** | (2006.01) |
| ***B05C 17/02*** | (2006.01) |
| ***B05C 17/03*** | (2006.01) |

(52) U.S. Cl.
CPC ..... *A45D 34/041* (2013.01); *A45D 34/04* (2013.01); *A45D 40/26* (2013.01); *A45D 40/261* (2013.01); *B05C 17/02* (2013.01); *B05C 17/0227* (2013.01); *B05C 17/03* (2013.01)

(58) Field of Classification Search
CPC ..... A45D 34/00; A45D 34/04; A45D 34/041; A45D 2200/10; A45D 40/26; A45D 40/261; B05C 17/02; B05C 17/0227; B05C 17/03
USPC ..... 401/28, 208–216
See application file for complete search history.

(56) References Cited

U.S. PATENT DOCUMENTS

| | | | | |
|---|---|---|---|---|
| 4,811,726 A * | 3/1989 | Goncalves | ..... | A61H 15/02 222/521 |
| 5,131,384 A * | 7/1992 | Obagi | ..... | A61H 15/02 601/154 |
| 11,259,618 B1 * | 3/2022 | Feterman | ..... | A45D 34/041 |

FOREIGN PATENT DOCUMENTS

| | | |
|---|---|---|
| CN | 211410068 U | 9/2020 |
| KR | 102161468 B1 | 10/2020 |

* cited by examiner

*Primary Examiner* — David J Walczak
(74) *Attorney, Agent, or Firm* — Jason L DeFrancesco

(57) ABSTRACT

A cosmetic package for dispensing and applying a fluid product, the cosmetic package comprises a container for accommodating the fluid product and an applicator head coupled to the container. The applicator head comprises a plurality of ball members, an upper plate, a lower plate, and a connector. The lower plate supports the plurality of the ball members on an upper surface thereof. The upper plate covers the lower plate such that a part of the plurality of ball members is exposed to the outside through a plurality of openings of the upper plate. A duct of the upper plate extends through the lower plate and connects to an internal duct of the connector so that the fluid product can move from the internal duct of the connector to the upper plate and can be dispensed through a dispensing orifice formed in the upper plate.

21 Claims, 7 Drawing Sheets

COSMETIC PACKAGE FOR DISPENSING AND APPLYING A FLUID PRODUCT

BACKGROUND

Field

The present disclosure generally relates to a cosmetic package for applying a fluid product including a cosmetic, care or pharmaceutical product, onto keratinous substrate such as skin, lips, under eyes, eyelids, cheeks, neck, nails or any other part of the body. In particular the present disclosure discloses the cosmetic package is provided with plurality of rotatable ball members that rotate to provide a massage function during application.

Description of the Related Art

Cosmetic packages with rotatable balls are generally used in many cosmetic products that are being use to give a sensational massage effect to any part of the body and also to apply a product including a cosmetic, care or pharmaceutical product, onto keratinous substrate such as skin, lips, under eyes, cheeks, nails or any other part of the body.

Korean patent KR102161468B1 discloses an embodiment of the present invention, a cosmetic container having a massage function is provided. The cosmetic container includes a container body in which the contents are stored; a nozzle unit coupled is to an upper portion of the container body and have a discharge hole formed at the upper end of the container body; at least one ball disposed at an upper end of the nozzle part along the circumference of the discharge hole and is rotatably coupled to the nozzle part; and a stopper coupled to the discharge hole to seal the discharge hole and discharges the contents toward the at least one ball by opening the discharge hole in response to the discharge pressure of the contents.

Chinese patent CN211410068U discloses a ball massage head comprising a base, a massage head device arranged on the base, an upper cover for covering the massage head device, and a hose which is detachably arranged on the base and is used for containing skin care liquid; the first device of massage includes shell, inner shell and massage ball, the massage ball adaptation is installed on the inner shell, shell detachably installs on the inner shell of having installed the massage ball, be equipped with a plurality of adaptations of being used for of adaptation installation on the shell the round hole of massage ball and the liquid outlet that is used for exporting skin lotion, the adaptation is equipped with the through-hole that is used for the liquid outlet to pass on the inner shell, the massage head is through using with the hose cooperation, can directly remove the hose when paining skin lotion and make the ball roll on skin and massage, the difference with the current product on the market.

There is still a need for a cosmetic package that provides an applicator head which enables a gentle massaging and application while covering a large area during application.

SUMMARY

Accordingly, there is provided a cosmetic package for applying a fluid product including a cosmetic, care or pharmaceutical product, onto keratinous substrate such as skin, lips, under eyes, eyelids, cheeks, neck, nails or any other part of the body. The cosmetic package comprises an applicator head, a container, and a cap. The applicator head includes a plurality of ball members, an upper plate, a lower plate, and a connector. The connector couples the applicator head to the container. An at least a portion of the plurality of ball members and an upper surface of the upper plate defines an applicator surface that comes in contact with the skin of a user during application. The applicator surface defined by the upper plate is inclined with respect to a longitudinal axis of the cosmetic package and has a shape that provides an ergonomically comfortable angle to a user for an application.

According to an aspect of the present disclosure, the container is provided with an internal space in which the fluid product is accommodated. The container may be provided with a neck portion through which the cosmetics are discharged at an upper end thereof, and the outer surface of the neck portion may be formed with threads for coupling with corresponding threads formed on an inner surface of the applicator head. However, the coupling of the container with the applicator head may be achieved by any other coupling means known in the art other than the threads.

According to an aspect of the present disclosure, the container is shaped like a tube or a tottle. In alternate embodiments, the container may have any other desirable shape in which a space for accommodating a fluid product may be provided.

According to an aspect of the present disclosure, a lower portion of the connector comprises internal threads to engage with the corresponding threads present on the outer surface of the neck portion of the container.

Further, the connector comprises the lower portion, an upper portion, and a narrow waist region between the lower portion and the upper portion. The connector further includes an internal duct that is in fluid communication with the container. A lower end of the internal duct is received in the neck portion of the container. The internal duct comprises a lower duct portion, which extends in the lower portion and the narrow waist region of the connector, and an upper duct portion that extends in the upper portion of the connector. The upper duct portion is narrower than the lower duct portion. Furthermore, the upper duct portion is off-centered with respect to a central longitudinal axis of the cosmetic package, whereas the lower duct portion is centered with respect to a central longitudinal axis of the cosmetic package.

According to another aspect of the present disclosure, the lower portion of the connector flares downwardly and outwardly from the narrow waist region of the connector such that a lower peripheral edge of the connector aligns with a sidewall of the container and covers the neck portion and a shoulder portion of the container.

According to another aspect of the present disclosure, the upper portion of the connector flares upwardly and outwardly from the narrow waist region of the connector and forms a wide opening at an upper end of the connector.

According to yet another aspect of the present disclosure, the connector further comprises a horizontal inner wall located in the narrow waist region of the connector. The upper duct portion passes through the horizontal inner wall of the connector. A plurality of tubular coupling projections is located on an upper surface of the horizontal inner wall of the connector. The connector receives the lower plate at the wide opening at an upper end of the connector. The lower plate is dimensioned to fit snugly within the wide opening at the upper end of the connector. The connector includes a plurality of protrusions formed on an inner sidewall of the upper portion of the connector near the wide opening that supports a bottom surface of the lower plate and prevents any undesirable downward movement of the lower plate into the connector.

According to another aspect of the present disclosure, the lower plate comprises a plurality of depressions, a first opening, and a plurality of second openings. The plurality of depressions is formed on an upper surface of the lower plate for seating the corresponding plurality of the ball members. The first opening allows a duct of the upper plate to pass the through the lower plate and link to the connecter. The plurality of second openings allows the passage for a plurality of projections of the upper plate.

The plurality of the ball members may be a spherical shape, an ellipsoidal shape, or a combination thereof. The plurality of the ball members may be provided on a surface thereof with projections and depressions based on various shapes. The plurality of the ball members may be made of silicon, metal, or plastic material having an appropriate hardness. The plurality of the ball members may be made of a combination of two or more materials, each single material. In the present disclosure, the structure and material of the ball members are not particularly limited.

The upper plate covers the lower plate such that the ball members are sandwiched between the upper plate and the lower plate. This type of fitment allows the ball members to rotate 360-degrees in all directions when contacted with an application surface. The upper plate further includes a plurality of openings that aligns with the plurality of depressions of the lower plate, and wherein plurality of openings is of such dimension that allows the plurality of ball members to partially protrude outside from the plurality of openings.

The plurality of openings of the upper plate has a shape so that a part of the plurality of ball members is exposed to the outside and the plurality of ball members is supported so that it does not come off the outside. The upper plate may have a smooth curved shape at the edges to allow natural rolling motion by contacting the skin, and may be formed of an opaque or transparent material.

Each of the plurality of ball members protrudes from the upper surface of the upper plate to a height of 20% to 40% of the ball member diameter.

According to an aspect of the present disclosure, the lower plate is in close contact with a bottom surface of the upper plate to prevent leakage of the fluid product. Further, the lower plate may be of the same plastic or metal material as the upper plate, or may be of an elastic material with a little elasticity.

According to yet another aspect of the present disclosure, the upper plate includes the duct that extends downwardly from a top surface thereof to a bottom surface thereof, and forms a dispensing orifice on an upper surface of the upper plate. The duct of the upper plate extends through the first opening in the lower plate and connects to the upper duct portion of the connector so that fluid product can move into the duct of the upper plate through the internal duct of the connector and can be dispensed through the dispensing orifice. Thus, fluid product does not come in contact with the plurality of the ball members before dispensing. The dispensed fluid product can be then transferred or deposited onto the keratinous substrate, and further applied by the upper surface of the upper plate and the plurality of ball members. Thus, the internal duct of the connector and the duct of the upper plate and the dispensing orifice collectively define a dispensing path in the applicator head.

According to yet another aspect of the present disclosure, the upper plate further includes the plurality of projections that extends downwardly from the bottom surface of the upper plate. The plurality of projections of the upper plate extends through the plurality of second openings formed in the lower plate and connects with the plurality of tubular coupling projections of the connector to couple the upper plate with the connector. The plurality of projections of the upper plate is received within the plurality of tubular coupling projections of the connector. Each of the plurality of projections of the upper plate comprises a rib that snaps into a corresponding snap groove present in a corresponding tubular coupling projection of the plurality of tubular coupling projections of the connector.

According to yet another aspect of the present disclosure, the upper plate, the lower plate, and the wide opening of the connector, each one has an outer periphery with a convex portion and a concave portion, more particularly, with a lower side of the outer periphery being convex and an upper side being concave. The concave portion is concave towards the central longitudinal axis of the cosmetic package.

According to yet another aspect of the present disclosure, the upper plate and the lower plate, and the wide opening of the connector are all inclined with respect to the central longitudinal axis of the cosmetic package.

According to an aspect of the present disclosure, the applicator head or a part of the applicator head can be detachably coupled and may also be replaceable.

Further, the applicator head may be sealed or opened by the cap. More particularly, the connector includes at least one coupling protrusion that snap fits into a corresponding snap groove on an inner surface of a sidewall of the cap. Further, the cap may include a pintel projection that extends downwardly from a lower surface of the top wall of the cap and plugs into the dispensing orifice of the upper plate in order to seal the dispensing orifice when the cap is attached to the cosmetic package.

As per an embodiment of the disclosed disclosure, the container of the cosmetic package is made of a soft material that can suppress when applying a sufficient amount of force on the container. The force generates a pressure in the container which allows the fluid product to travel from the container to the internal duct of the connector and the duct of the upper plate of the applicator head, and dispense out from the dispensing orifice. The fluid product dispensed then can be applied using the upper surface of the upper plate and the plurality of ball members. The plurality of ball members rotates by the user's rolling motion and the fluid product discharged from the container can be massaged on the user's skin.

The upper plate may be of a gentle curved shape and may be formed of opaque or transparent material to allow natural thrusting to be applied to the skin.

As per an embodiment of the disclosed disclosure, the plurality of ball members can be made from any substance like thermal sensation absorbing material but not restricted to metal, stone, ceramic, glass, alloy, plastic or any other of this category.

Terms of orientation, such as "upper," "lower," "top" and "bottom," are used herein for purposes of clarity to identify the orientation relative to the drawings. Such terms are not intended to limit the scope of this disclosure or to exclude and equivalent structure.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
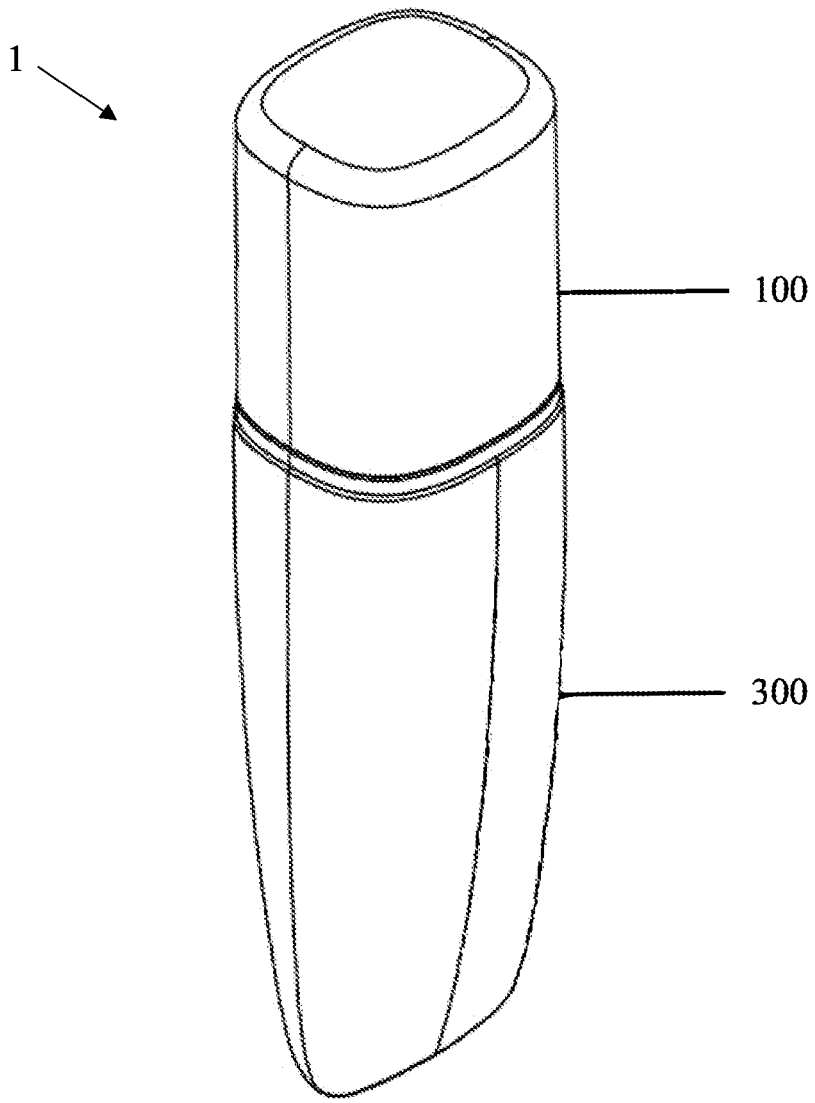
FIG. 1 illustrates an isometric view of a cosmetic package in a closed state according to the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Figure 2:
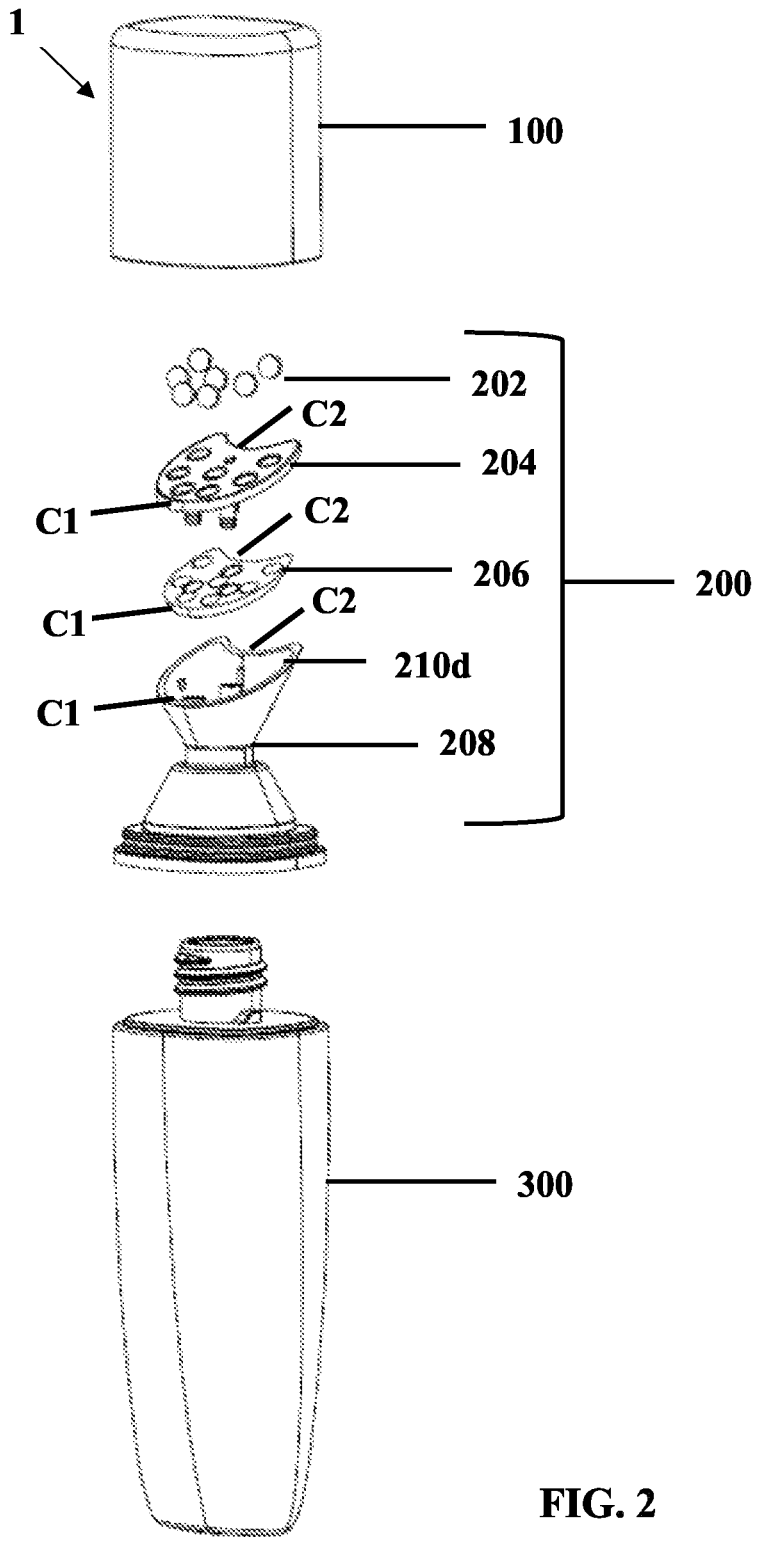
FIG. 2 illustrates an exploded view of the cosmetic package of FIG. 1.

FIG. 1 illustrates an isometric view of a cosmetic package 1 according present disclosure. The cosmetic package comprises a container 300 and a cap 100. FIG. 2 further shows an exploded view of the cosmetic package 1. The cosmetic package 1 comprises an applicator head 200, the container 300, and the cap 100. The cosmetic package is adapted for applying a fluid product including a cosmetic, care or pharmaceutical product, onto keratinous substrate such as skin, lips, under eyes, eyelids, cheeks, neck, nails or any other part of the body. The cosmetic package comprises an applicator head, a container, and a cap.

Figure 7A:
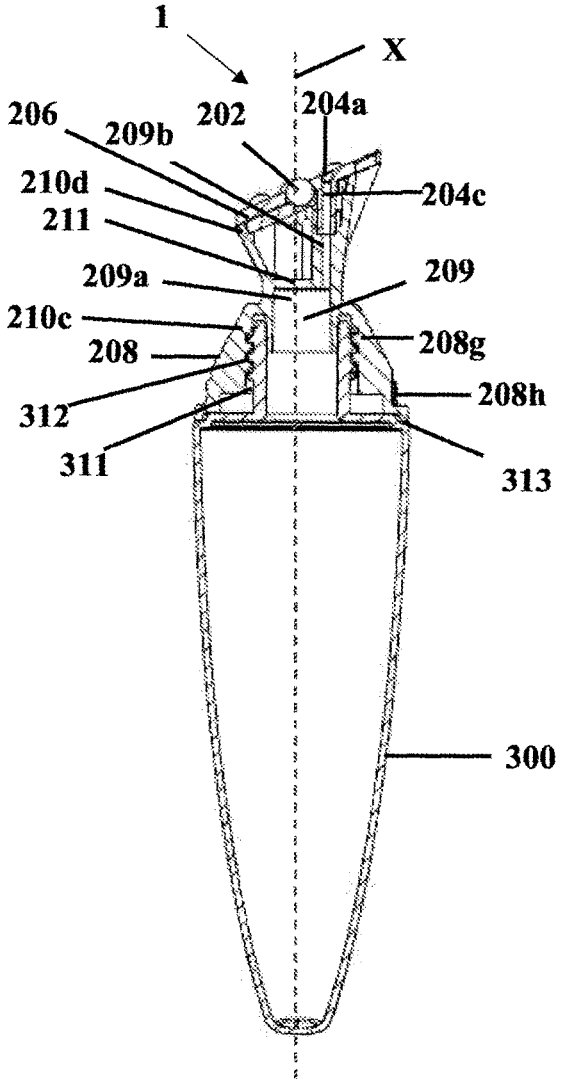
FIG. 7*a* illustrates a longitudinal cross sectional view of the cosmetic package of FIG. 1.

As shown in FIG. 7*a*, the container 300 is provided with an internal space in which the fluid product is accommodated. The container 300 may be provided with a neck portion 311 through which the fluid product is discharged at an upper end thereof, and the outer surface of the neck portion 311 may be formed with threads 312 for coupling with corresponding internal threads 208*g* formed on an inner surface of the applicator head 200. However, the coupling of the container 300 with the applicator head 200 may be achieved by any other coupling means known in the art other than the threads.

In the present embodiment, the container 300 is shaped like a tube or a tottle. In alternate embodiments, the container 300 may have any other desirable shape in which a space for accommodating a fluid product may be provided.

Figure 3A:
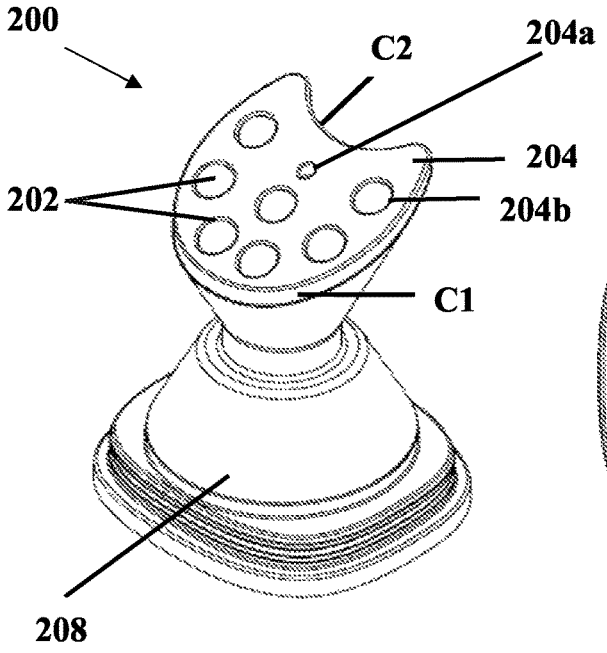
FIG. 3*a* illustrates an isometric view of an applicator head of the cosmetic package of FIG. 1.

Referring to FIGS. 2 and 3*a*, the applicator head 200 includes a plurality of ball members 202, an upper plate 204, a lower plate 206, and a connector 208. An at least a portion of the plurality of ball members 202 and an upper surface of the upper plate 204 defines an applicator surface that comes in contact with the skin of a user during application. The applicator surface defined by the upper plate 204 is inclined with respect to a longitudinal axis X of the cosmetic package 1 and has a shape that provides an ergonomically comfortable angle to a user for application, which will be explained later herein. The connector 208 couples the applicator head 200 to the container 300. More particularly, a lower portion 210*a* of the connector 208 comprises internal threads 208*g* (see FIG. 7*a*) to engage with the corresponding threads 312 present on the outer surface of the neck portion 311 of the container 300.

Figure 5A:
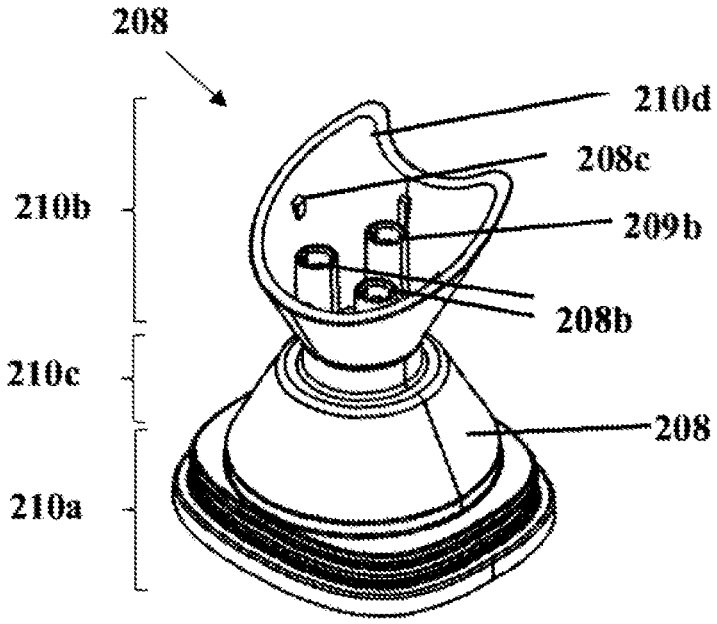
FIG. 5*a* illustrates an isometric view of an connector of the applicator head of FIG. 3*a;*
Figure 5B:
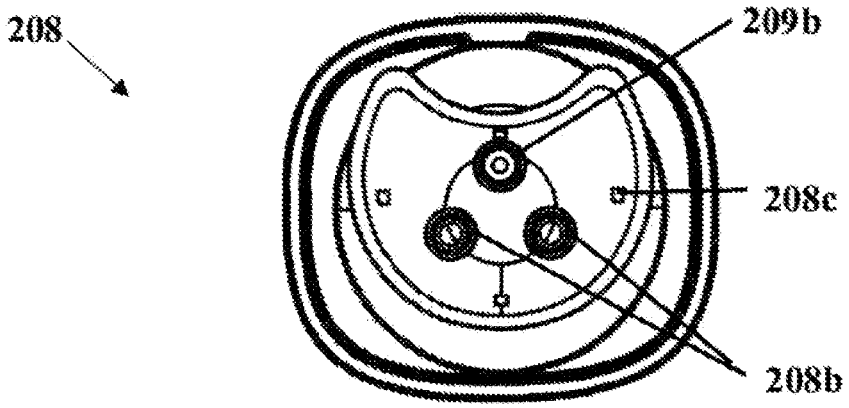
FIG. 5*b* illustrates a top view of the connector of FIG. 5*a;*

Referring to FIGS. 5*a*, 5*b* and 7*a*, the connector 208 comprises the lower portion 210*a*, an upper portion 210*b*, and a narrow waist region 210*c* between the lower portion 210*a* and the upper portion 210*b*. The connector 208 further includes an internal duct 209 that is in fluid communication with the container 300. A lower end of the internal duct 209 is received in the neck portion 311 of the container 300, see FIG. 7*a*. The internal duct 209 comprises a lower duct portion 209*a*, which extends in the lower portion 210*a* and the narrow waist region 210*c* of the connector 208, and an upper duct portion 209*b* that extends in the upper portion 210*b* of the connector 208. The upper duct portion 209*b* is narrower than the lower duct portion 209*a*. Furthermore, the upper duct portion 209*b* is off-centered with respect to a central longitudinal axis X of the cosmetic package 1, whereas the lower duct portion 209*a* is centered with respect to a central longitudinal axis X of the cosmetic package 1.

The lower portion 210*a* of the connector 208 flares downwardly and outwardly from the narrow waist region 210*c* of the connector 208 such that a lower peripheral edge of the connector 208 aligns with a sidewall of the container 300 and covers the neck portion 311 and a shoulder portion 313 of the container 300, refer FIG. 7*a*.

Figure 7B:
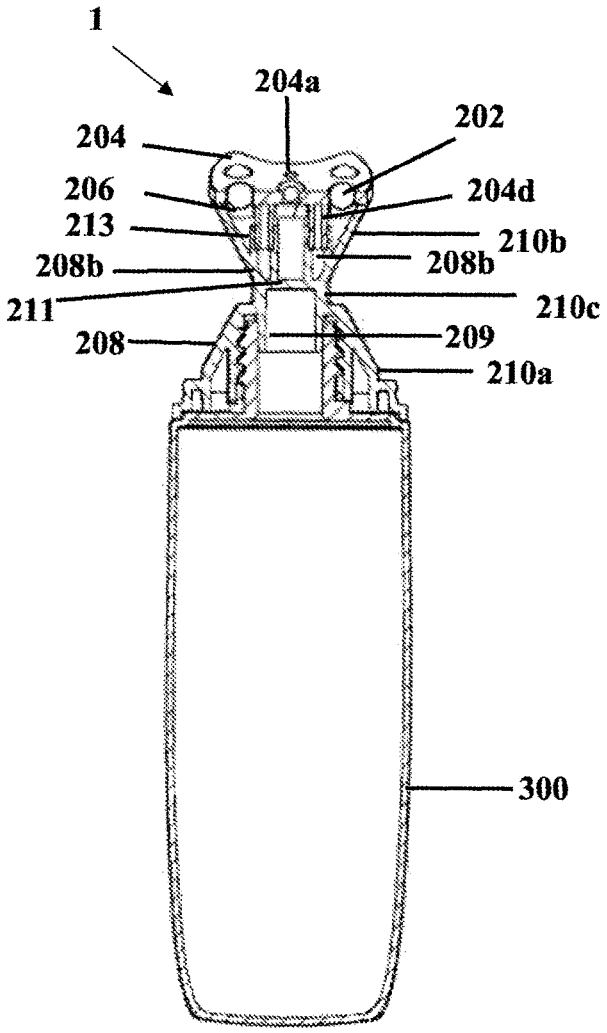
FIG. 7*b* illustrates another longitudinal cross sectional view of the cosmetic package of FIG. 1.

Referring to FIGS. 5*a* and 7*b*, the upper portion 210*b* of the connector 208 flares upwardly and outwardly from the narrow waist region 210*c* of the connector 208 and forms a an opening 210*d*, more particularly, a wide opening 210*d* at an upper end of the connector 208.

Referring to FIGS. 7*a* and 7*b*, the connector 208 further comprises a horizontal inner wall 211 located in the narrow waist region 210*c* of the connector 208. The upper duct portion 209*b* passes through the horizontal inner wall 211 of the connector 208. A plurality of tubular coupling projections 208*b* is located on an upper surface of the horizontal inner wall 211 of the connector 208, refer FIGS. 7*b*, 5*a* and 5*b*. The connector 208 receives the lower plate 206 at the wide opening 210*d* at an upper end of the connector 208. The lower plate 206 is dimensioned to fit snugly within the wide opening 210*d* at the upper end of the connector 208. The connector 208 further includes a plurality of protrusions 208*c* formed on an inner sidewall of the upper portion 210*b* of the connector 208 near the wide opening 210*d* that supports a bottom surface of the lower plate 206 and prevents any undesirable downward movement of the lower plate 206 into the connector 208.

Figure 6A:
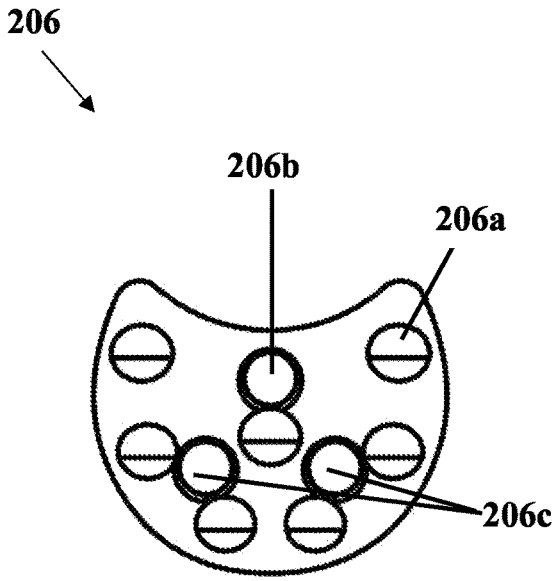
FIG. 6*a* illustrates an top view of a lower plate of the applicator head of FIG. 3*a;*
Figure 6B:
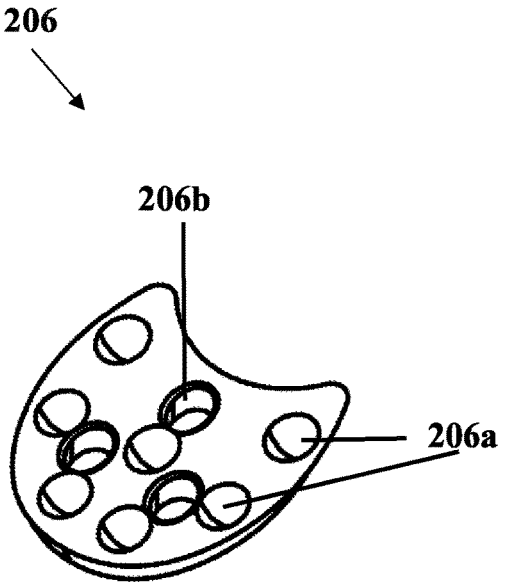
FIG. 6*b* illustrates an isometric view of the lower plate of FIG. 6*a;*
Figure 6C:
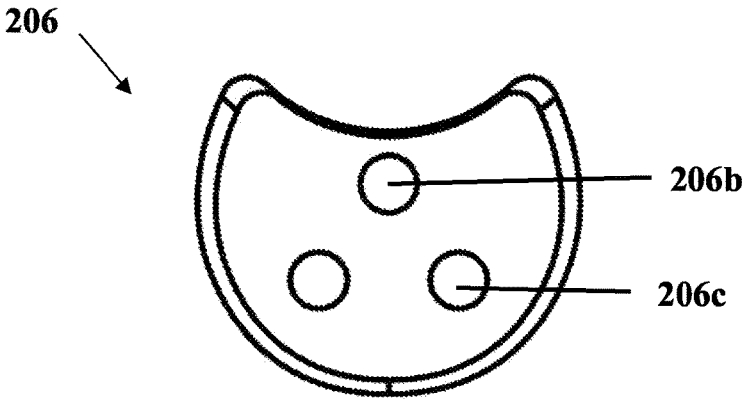
FIG. 6*c* illustrates a bottom view of the lower plate FIG. 6*a;*

As seen in the FIGS. 6*a*-6*c*, the lower plate 206 has a plate-like body that comprises a plurality of depressions 206*a*, a first opening 206*b* and a plurality of second openings 206*c*. The plurality of depressions 206*a* is formed on an upper surface of the lower plate 206 for seating the corresponding plurality of the ball members 202. The first opening 206*b* allows a duct 204*c* of the upper plate 204 to pass through the lower plate 206 and connect to the internal duct 209 of the connecter 208, see FIG. 7*a*. The plurality of second openings 206*c* allows the passage for a plurality of projections 204*d* of the upper plate 204, refer FIG. 7*b*.

The plurality of the ball members 202 may be a spherical shape, an ellipsoidal shape, or a combination thereof. The plurality of the ball members 202 may be provided on a surface thereof with projections and depressions based on various shapes. The plurality of the ball members 202 may be made of silicon, metal, or plastic material having an appropriate hardness. The plurality of the ball members 202 may be made of a combination of two or more materials, each single material. In the present disclosure, the structure and material of the plurality of ball members 202 are not particularly limited.

As shown in FIGS. 7*a* and 7*b*, the upper plate 204 covers the lower plate 206 such that the plurality of ball members 202 are sandwiched between the upper plate 204 and the lower plate 206. This type of fitment allows the plurality of ball members 202 to rotate 360-degrees in all directions when contacted with an application surface. The upper plate 204 has a plate-like body that include a plurality of openings 204*b* that aligns with the plurality of depressions 206*a* of the lower plate 206, and wherein plurality of openings 204*b* is of such dimension that allows the plurality of ball members 202 to partially protrude outside from the plurality of openings 204*b*, refer FIGS. 3*a*, 4*a* and 7*b*.

Figure 4A:
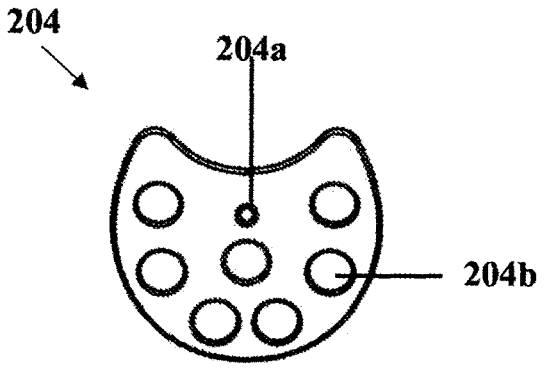
FIG. 4*a* illustrates a top view of an upper plate of the applicator head of FIG. 3*a;*
Figure 4B:
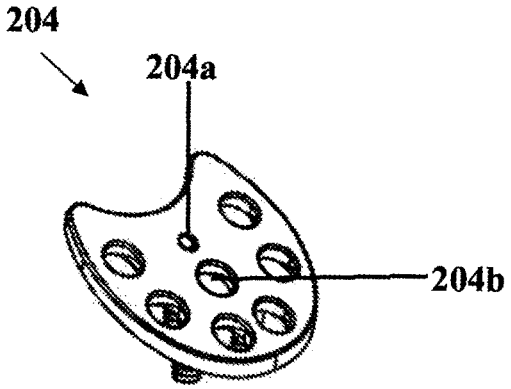
FIG. 4*b* illustrates an isometric view of the upper plate of FIG. 4*a;*
Figure 4C:
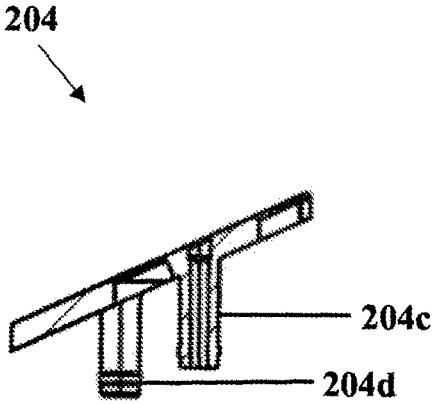
FIG. 4*c* illustrates a cross-sectional view of the upper plate FIG. 4*a;*

Referring to FIGS. 3*a* and 4*a*, the plurality of openings 204*b* of the upper plate 204 has a shape so that a part of the plurality of ball members 202 is exposed to the outside and the plurality of ball members 202 is supported so that it does not come off the outside. The upper plate 204 may have a smooth curved shape at the edges to allow natural rolling motion by contacting the skin, and may be formed of an opaque or transparent material.

Each of the plurality of ball members 202 protrudes from an upper surface of the upper plate 204 to a height of 20% to 40% of the ball member 202 diameter.

As seen in FIG. 7*b*, the lower plate 206 is in close contact with a bottom surface of the upper plate 204 to prevent leakage of the fluid product. Further, the lower plate 206 may be of the same plastic or metal material as the upper plate 204, or may be of an elastic material with a little elasticity.

Referring to FIGS. 4*a*-4*d*, the upper plate 204 further includes the duct 204*c* that extends downwardly from a top surface thereof to a bottom surface thereof, and forms a dispensing orifice 204*a* on an upper surface of the upper plate 204. The duct 204*c* of the upper plate 204 extends through the first opening 206*b* in the lower plate 206 and connects to the upper duct portion 209*b* of the connector 208 so that fluid product can move into the duct 204*c* of the upper plate 204 through the internal duct 209 of the connector 208 and can be dispensed through the dispensing orifice 204*a*, refer FIG. 7*a*. Thus, fluid product does not come in contact with the plurality of the ball members 202 before dispensing. The dispensed fluid product can be then transferred or deposited onto the keratinous substrate, and further applied by the upper surface of the upper plate 204 and the plurality of ball members 202. Thus, the internal duct 209 of the connector 208 and the duct 204*c* of the upper plate 204 and the dispensing orifice 204*a* collectively define a dispensing path in the applicator head 200, refer FIG. 7*a*.

Figure 4D:
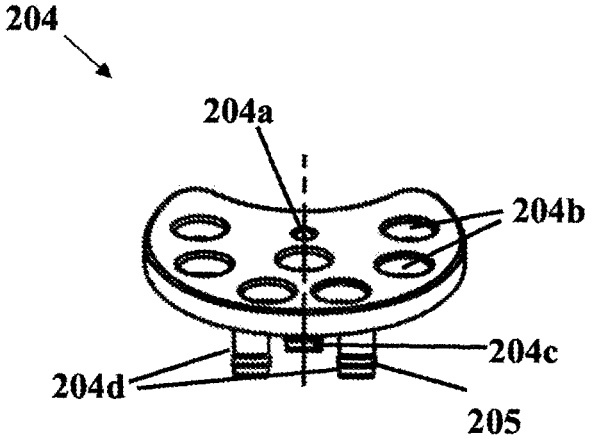
FIG. 4*d* illustrates a front isometric view of the upper plate of FIG. 4*a;*

The upper plate 204 further includes the plurality of projections 204*d* that extends downwardly from the bottom surface of the upper plate 204. The plurality of projections 204*d* of the upper plate 204 extends through the plurality of second openings 206*c* formed in the lower plate 206 and connects with the plurality of tubular coupling projections 208*b* of the connector 208 to couple the upper plate 204 with the connector 208, refer FIG. 7*b*. The plurality of projections 204*d* of the upper plate 204 is received within the plurality of tubular coupling projections 208*b* of the connector 208. Referring to FIGS. 4*d* and 7*b*, each of the plurality of projections 204*d* of the upper plate 204 comprises a rib 205 that snap fits into a corresponding snap groove 213 present in an inner surface of a corresponding tubular coupling projection 208*b* of the plurality of tubular coupling projections 208*b* of the connector 208.

Referring to FIG. 2, the upper plate 204, the lower plate 206, and the wide opening 210*d* of the connector 208, each one has an outer periphery with a convex portion C1 and a concave portion C2, more particularly, with a lower side of the outer periphery being convex and an upper side being concave. The concave portion C2 is concave towards the central longitudinal axis of the cosmetic package 1.

According to an aspect of the present disclosure, the upper plate 204, the lower plate 206, and the wide opening 210*d* of the connector 208 are all inclined with respect to the central longitudinal axis of the cosmetic package 1. The upper plate 204, the lower plate 206 makes a non-zero angle with respect to the longitudinal axis X of the cosmetic package 1. In a preferred implementation, the non-zero angle is about 60-80° which provides a comfortable angle of application during use. However, other designs may be used. For example, in other implementations, the non-aero angle may be between about 100 and about 80°.

According to an aspect of the present disclosure, the applicator head 200 or a part of the applicator head 200 can be detachably coupled and may also be replaceable.

Further, the applicator head 200 may be sealed or opened by the cap 100. More particularly, the connector 208 includes at least one coupling protrusion 208*h* (see FIG. 7*a*) that snap fits into a corresponding snap groove (not shown) on an inner surface of a sidewall of the cap 100. Further, although not shown, the cap 100 may include a pintel projection that extends downwardly from a lower surface of the top wall of the cap 100 and plugs into the dispensing orifice 204*a* of the upper plate 204 in order to seal the dispensing orifice 204*a* when the cap 100 is attached to the cosmetic package 1.

As per an embodiment of the disclosed disclosure, shown in FIGS. 7*a* and 7*b*, the container 300 of the cosmetic package 1 is made of a soft material that can suppress when applying a sufficient amount of force on the container 300. The force generates pressure in the container 300 which allows the fluid product to travel from the container 300 to the internal duct 209 of the connector 208 and the duct 204*c* of the upper plate 204 of the applicator head 200 and dispense out from the dispensing orifice 204*a*. The fluid product dispensed then can be applied using the upper surface of the upper plate 204 and the plurality of ball members 202. The plurality of ball members 202 rotates by the user's rolling motion and fluid product discharged from the container 300 can be massaged on the user's skin.

The upper plate 204 may be of a gentle curved shape and may be formed of opaque or transparent material to allow natural thrusting to be applied to the skin.

Figure 3B:
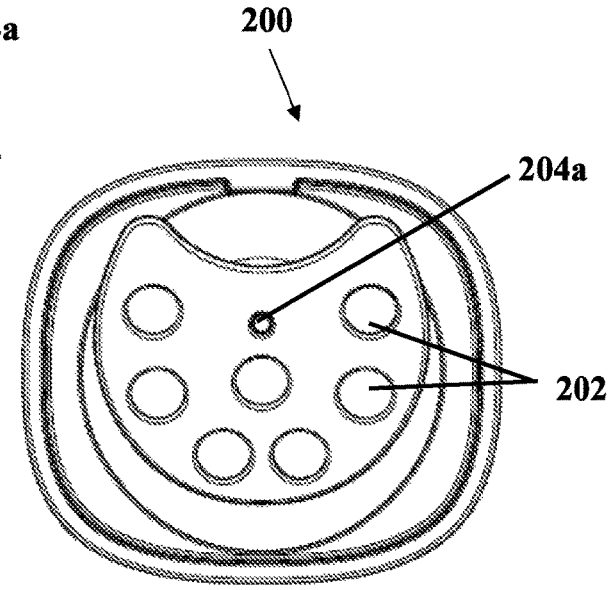
FIG. 3*b* illustrates a top view of an applicator head of FIG. 3*a;*
Figure 3C:
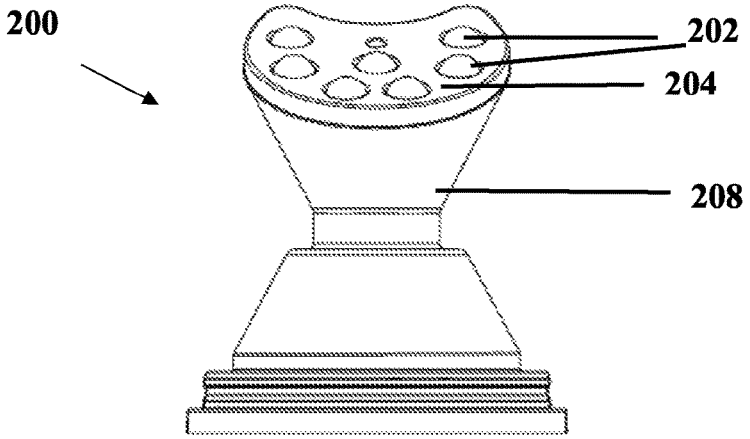
FIG. 3*c* illustrates a front view of an applicator head of FIG. 3*a;*

FIGS. 3*a* and 3*b* show an arrangement of the plurality of ball members 202 on the applicator head 200. A majority of plurality of ball members 202 are arranged in peripheral direction on the upper plate 204 along the convex portion C1 of the outer periphery of the upper plate 204, and at least one ball member of the plurality of ball members 202 is located at a central region of the upper plate 204. The dispensing orifice 204*a* lies close to the concave portion C2 of the outer periphery of the upper plate 204 on the upper surface of the upper plate 204.

As per an embodiment of the disclosed disclosure, the plurality of ball members 202 can be made from any substance like thermal sensation absorbing material but not restricted to metal, stone, ceramic, glass, alloy, plastic or any other of this category.

Terms of orientation, such as "upper," "lower," "top" and "bottom," are used herein for purposes of clarity to identify the orientation relative to the drawings. Such terms are not intended to limit the scope of this disclosure or to exclude and equivalent structure.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. A cosmetic package for dispensing and applying a fluid product, the cosmetic package comprising:

a container for accommodating the fluid product;

an applicator head coupled to the container;

wherein the applicator head comprises a plurality of ball members, an upper plate, a lower plate, and a connector;

wherein the connector includes an internal duct, a plurality of tubular coupling projections that extend upward from a horizontal inner wall of the connector, and a wide opening at an upper end of the connector;

wherein the lower plate has a plate-like body that comprises a plurality of depressions on an upper surface thereof, a first opening, and a plurality of second openings;

wherein the upper plate has a plate-like body that comprises a plurality of openings, a duct that extends downward from a bottom surface of the upper plate and terminates in a dispensing orifice on the upper surface of the upper plate, and a plurality of projections that extends downward from the bottom surface of the upper plate;

wherein the lower plate is located within the wide opening at the upper end of the connector;

wherein the plurality of depressions of the lower plate provide a seating for the plurality of the ball members;

wherein the upper plate covers the lower plate such that a part of the plurality of ball members is exposed to an outside through the plurality of openings of the upper plate;

wherein the upper plate is coupled to the connector by means of the plurality of projections of the upper plate that extends through the plurality of second openings of the lower plate and couples with the plurality of tubular coupling projections of the connector; and wherein the duct of the upper plate extends through the first opening of the lower plate and connects to the internal duct of the connector so that the fluid product can move from the connector to the upper plate and dispensed through the dispensing orifice.

2. The cosmetic package according to claim 1, wherein the plurality of projections of the upper plate is received within the plurality of tubular coupling projections of the connector; wherein each of the plurality of projections of the upper plate comprises a rib that snaps into a corresponding snap groove present in an inner surface of a corresponding tubular coupling projection of the plurality of tubular coupling projections of the connector.

3. The cosmetic package according to claim 1, wherein each one of the upper plate, the lower plate, and the wide opening of the connector has an outer periphery with a convex portion and a concave portion; wherein concave portion of the outer periphery of each of the upper plate, the lower plate and the wide opening of the connector are aligned with one another.

4. The cosmetic package according to claim 3, wherein a majority of the plurality of ball members are arranged uniformly in a peripheral direction on the upper plate along the convex portion of the outer periphery of the upper plate, and at least one ball member of the plurality of ball members is located at a central region of the upper plate; and wherein the dispensing orifice is located on the upper surface of the upper plate close to the concave portion of the outer periphery of the upper plate.

5. The cosmetic package according to claim 1, wherein the upper plate, the lower plate, and the wide opening of the connector are all inclined with respect to the central longitudinal axis of the cosmetic package.

6. The cosmetic package according to claim 5, wherein both the upper plate and the lower plate make a non-zero angle with respect to a longitudinal axis of the cosmetic package and wherein the non-zero angle is selected from a range of about 60-80°.

7. The cosmetic package according to claim 1, wherein the connector includes a plurality of protrusions formed on an inner sidewall of the connector near the wide opening of the connector to support to a bottom surface of the lower plate and prevent downward movement of the lower plate into the connector.

8. The cosmetic package according to claim 1, wherein the connector comprises a lower portion, an upper portion, and a narrow waist region between the lower portion and the upper portion; wherein the internal duct comprises a lower duct portion which extends in the lower portion and the narrow waist region of the connector, and an upper duct portion that extends in the upper portion of the connector.

9. The cosmetic package according to claim 8, the upper duct portion is narrower than the lower duct portion; and wherein the upper duct portion is off-centered with respect to a central longitudinal axis of the cosmetic package and the lower duct portion is centered with respect to a central longitudinal axis of the cosmetic package.

10. The cosmetic package according to claim 8, wherein the lower portion of the connector flares downwardly and outwardly from the narrow waist region of the connector such that a lower peripheral edge of the connector aligns with a sidewall of the container and covers a neck portion and a shoulder portion of the container.

11. The cosmetic package according to claim 1, wherein a lower portion of the connector a comprises internal threads to engage with corresponding threads present on an outer surface of a neck portion of the container.

12. The cosmetic package according to claim 1, wherein the upper portion of the connector flares upwardly and outwardly from the narrow waist region of the connector and forms the wide opening at the upper end of the connector.

13. The cosmetic package according to claim 1, wherein at least one of the plurality of the ball members is free to rotate 360 degrees in all directions.

14. A cosmetic package for dispensing a fluid product, the cosmetic package comprising:

a container for accommodating the fluid product;

an applicator head coupled to the container;

wherein the applicator head comprises a plurality of ball members, an upper plate, a lower plate, and a connector;

wherein the connector includes an internal duct and an opening at an upper end of the connector;

wherein the lower plate has a plate-like body that comprises a plurality of depressions on an upper surface thereof, and a first opening;

a wherein the upper plate has a plate-like body that comprises a plurality of openings and a duct that extends downward from a bottom surface of the upper plate and terminates in a dispensing orifice on the upper surface of the upper plate;

wherein the lower plate is located within the opening at the upper end of the connector;

wherein the plurality of depressions of the lower plate provide seating for the plurality of the ball members;

wherein the upper plate covers the lower plate such that a part of the plurality of ball members is exposed to the outside through the plurality of openings of the upper plate;

wherein at least one of the plurality of ball members is free to rotate 360 degrees in all directions; and wherein the duct of the upper plate extends through the first opening of the lower plate and connects to the internal duct of the connector so that the fluid product can move from the connector to the upper plate and dispensed through the dispensing orifice.

15. The cosmetic package according to claim 14, wherein the connector includes a plurality of tubular coupling projections that extend upward from a horizontal inner wall of the connector; wherein the lower plate comprises a plurality of second openings; wherein the upper plate has a plurality of projections that extend downward from the bottom surface of the upper plate; and wherein the upper plate is coupled to the connector by means of the plurality of projections of the upper plate that extends through the plurality of second openings of the lower plate and couples with the plurality of tubular coupling projections of the connector.

16. The cosmetic package according to claim 14, wherein the upper plate and the lower plate are inclined with respect to a central longitudinal axis of the cosmetic package.

17. A cosmetic package for dispensing and applying a fluid product, the cosmetic package comprising:

a container for accommodating the fluid product;

an applicator head coupled to the container;

wherein the applicator head comprises a plurality of ball members, an upper plate, a lower plate, and a connector;

wherein the connector includes an internal duct and an opening at an upper end of the connector;

wherein the lower plate has a plate-like body that comprises a plurality of depressions on an upper surface thereof;

wherein the plurality of depressions of the lower plate provide seating for the plurality of the ball members;

wherein at least one of the plurality of ball members is free to rotate 360 degrees in all directions;

wherein the lower plate is located within the opening at the upper end of the connector;

wherein the upper plate has a plate-like body that comprises a plurality of openings and has a dispensing orifice on an upper surface of the upper plate;

wherein the upper plate is placed on top of the lower plate such that a part of the plurality of ball members is exposed to the outside through the plurality of openings of the upper plate;

wherein the upper plate is coupled to the connector;

wherein the upper plate and the lower plate are similar in shape, and each one of the upper plate and the lower plate has an outer periphery with a convex portion and a concave portion;

wherein the concave portion and convex portion of the outer periphery of each of the upper plate, the lower plate are aligned with one another;

wherein the upper plate, the lower plate are inclined with respect to a central longitudinal axis of the cosmetic package; and wherein the dispensing orifice is located on the upper surface of the upper plate close to the concave portion of the outer periphery of the upper plate.

18. The cosmetic package according to claim 17, wherein the connector includes a plurality of tubular coupling projections that extend upward from a horizontal inner wall of the connector, wherein the lower plate includes a first opening, and a plurality of second openings; wherein the upper plate includes a duct that extends downward from a bottom surface of the upper plate and terminates in the dispensing orifice on the upper surface of the upper plate, and a plurality of projections that extends downward from the bottom surface of the upper plate.

19. The cosmetic package according to claim 18, wherein the upper plate is coupled to the connector by means of the plurality of projections of the upper plate that extends through the plurality of second openings of the lower plate and couples with the plurality of tubular coupling projections of the connector.

20. The cosmetic package according to claim 18, wherein the duct of the upper plate extends through the first opening of the lower plate and connects to the internal duct of the connector so that the fluid product can move from the connector to the upper plate and dispensed through the dispensing orifice.

21. The cosmetic package according to claim 17, wherein a majority of the plurality of ball members are arranged uniformly in a peripheral direction on the upper plate along the convex portion of the outer periphery of the upper plate; and wherein at least one ball member of the plurality of ball members is located at a central region of the upper plate.

* * * * *